US008176980B2

(12) United States Patent
Sanmiguel et al.

(10) Patent No.: US 8,176,980 B2
(45) Date of Patent: May 15, 2012

(54) METHOD OF GAS-CAP AIR INJECTION FOR THERMAL OIL RECOVERY

(75) Inventors: Javier Enrique Sanmiguel, Calgary (CA); Matthew Abram Toews, Calgary (CA); Larry Wayne Freeman, Calgary (CA)

(73) Assignee: FCCL Partnership, Calgary (CA)

( * ) Notice: Subject to any disclaimer, the term of this patent is extended or adjusted under 35 U.S.C. 154(b) by 70 days.

(21) Appl. No.: 12/701,240

(22) Filed: Feb. 5, 2010

(65) Prior Publication Data

US 2010/0218942 A1 Sep. 2, 2010

Related U.S. Application Data

(60) Provisional application No. 61/150,513, filed on Feb. 6, 2009.

(51) Int. Cl.
*E21B 43/24* (2006.01)
*E21B 43/243* (2006.01)

(52) U.S. Cl. ..... 166/258; 166/272.1; 166/272.3; 166/272.7

(58) Field of Classification Search ..... 166/258
See application file for complete search history.

(56) References Cited

U.S. PATENT DOCUMENTS

| | | | | |
|---|---|---|---|---|
| 3,072,187 | A * | 1/1963 | Carr | 166/258 |
| 3,097,690 | A * | 7/1963 | Terwilliger et al. | 166/259 |
| 3,193,008 | A * | 7/1965 | Moore | 166/258 |
| 3,376,246 | A | 12/1971 | Sklar et al. | |
| 3,794,113 | A | 2/1974 | Strange | |
| 3,872,924 | A * | 3/1975 | Clampitt | 166/261 |
| 3,999,606 | A | 12/1976 | Bandyopadhyay et al. | |
| 4,116,275 | A | 9/1978 | Butler et al. | |
| 4,124,071 | A | 11/1978 | Allen et al. | |
| 4,280,559 | A | 7/1981 | Best | |
| 4,344,485 | A | 8/1982 | Butler | |
| 4,393,936 | A * | 7/1983 | Josendal | 166/402 |
| 4,993,490 | A | 2/1991 | Stephens et al. | |
| 5,211,230 | A | 5/1993 | Ostapovich et al. | |
| 5,339,897 | A | 8/1994 | Leaute | |
| 5,456,315 | A | 10/1995 | Kisman et al. | |
| 5,626,191 | A | 5/1997 | Greaves et al. | |
| 7,493,953 | B2 | 2/2009 | Ayasse | |
| 7,516,789 | B2 | 4/2009 | Chhina et al. | |
| 7,520,325 | B2 | 4/2009 | Hocking | |
| 7,644,765 | B2 | 1/2010 | Stegemeier et al. | |
| 7,900,701 | B2 | 3/2011 | Weiers | |

(Continued)

FOREIGN PATENT DOCUMENTS

| | | |
|---|---|---|
| CA | 1056720 | 6/1979 |

(Continued)

*Primary Examiner* — George Suchfield
(74) *Attorney, Agent, or Firm* — SNR Denton US LLP

(57) ABSTRACT

A method for producing bitumen or heavy oil from a subsurface oil sands reservoir, the subsurface oil sands reservoir and an overlying gas zone in fluid communication, the method includes providing an in situ combustion process in the overlying gas zone, to create or expand a combustion front within the overlying gas zone, providing a thermal recovery process in the oil sands reservoir, to create or expand a rising hot zone within the oil sands reservoir, and selectively operating the thermal recovery process or the in situ combustion process or both such that the rising hot zone does not intersect the overlying gas zone until the combustion front has moved beyond that portion of the overlying gas zone at the intersection.

30 Claims, 2 Drawing Sheets

U.S. PATENT DOCUMENTS

| | | | | |
|---|---|---|---|---|
| 7,934,549 | B2 * | 5/2011 | Cimolai | 166/258 |
| 2001/0049342 | A1 * | 12/2001 | Passey et al. | 507/200 |
| 2008/0093071 | A1 * | 4/2008 | Weiers et al. | 166/260 |
| 2010/0108317 | A1 * | 5/2010 | Cimolai | 166/272.3 |
| 2010/0175872 | A1 * | 7/2010 | Brown et al. | 166/258 |

FOREIGN PATENT DOCUMENTS

| | | |
|---|---|---|
| CA | 2096034 | 7/1996 |
| CA | 2594413 | 7/2006 |

* cited by examiner

METHOD OF GAS-CAP AIR INJECTION FOR THERMAL OIL RECOVERY

CROSS REFERENCE TO RELATED APPLICATIONS

This application claims the benefit of priority of U.S. Provisional Patent Application No. 61/150,513 filed Feb. 6, 2009, which is incorporated herein by reference in its entirety.

FIELD OF THE INVENTION

The present invention relates generally to recovery of bitumen or heavy oil. More particularly, the present invention relates to recovery of bitumen or heavy oil from a subsurface reservoir overlain by a gas zone.

BACKGROUND OF THE INVENTION

An oil sand (i.e., a reservoir whose pore volume contains a significant level of bitumen saturation) may exist substantially in isolation, or may be underlain or overlain by hydraulically contiguous formations that have significant saturations of other fluids, such as gas or water, or both.

In one such configuration which occurs commonly in Canada's oil sands, an oil sand is overlain by a contiguous gas zone with which the oil sand is in hydraulic communication.

There are several techniques known for the recovery of bitumen from the oil sand. However, we cite some technology whose well configurations may bear some resemblance to that of the present invention, but whose processes for bitumen recovery are markedly different from that of the present invention, as follows.

U.S. Pat. No. 4,116,275 to Butler et al. relates to a method for recovering hydrocarbons from a hydrocarbon-bearing formation. A heated fluid, such as steam, is injected into the formation, such as a tar sand formation, via a suitably completed horizontal well, and subsequently, formation hydrocarbons are produced via the well.

U.S. Pat. No. 4,280,559 to Best relates to a process for in situ recovery of viscous oil from a subterranean formation. Steam is injected into the formation via a well, permitted to soak, and heated fluids including heated viscous oil are produced sufficient to create a substantial fluid mobility in the formation. Then a hydrocarbon solvent is injected into the formation and another steam injection, soak and oil production cycle is performed to recover additional quantities of oil.

U.S. Pat. No. 4,344,485 to Butler relates to a thermal method for recovering normally immobile oil from a tar sand (oil sand) deposit. Two wells horizontal wells are drilled, one for injection of heated fluid (steam) and one for production of liquids. Thermal communication is established between the wells, and the wells are operated such that the mobilized oil and steam flow without substantially mixing. Oil drains continuously by gravity to the production well where it is recovered.

Canadian Patent No. 2,096,034 to Kisman et al. is directed at recovery of bitumen. The recovery process, commonly referred to as COSH_(COSH is the acronym of Combustion Override Split-production Horizontal-well), is an in situ combustion process. The COSH process mentions the use of steam injection at the vertical injector, either to establish communication with the horizontal producer or to heat the region around the vertical injector so that ignition can occur. The horizontal producer is not engaged in steam injection. Bitumen is largely mobilized from above through in situ combustion and is passively received by the horizontal well.

U.S. Pat. No. 5,626,191 to Greaves et al. describes a well arrangement in which production wells are generally horizontal, positioned low in the reservoir, with a row of vertical air injection wells that are used to propagate a combustion front within the reservoir.

Canadian Patent Application No. 2,594,413 to Nzekwu et al., titled In situ Combustion in Gas Over Bitumen Formations, relates to recovery of gas from an overlying gas zone. In this process, air is injected into a gas zone which overlies an oil sand, in situ combustion is initiated within the gas zone, and the resulting combustion gases horizontally displace the natural gas to nearby production wells for recovery. The pressuring of the gas zone may be followed by depletion of the heavy oil zone, or the depletion of the heavy oil zone may be concurrent with pressuring within the gas zone. The heavy oil may be recovered by a process that comprises injecting a heated fluid into the heavy oil zone and producing hydrocarbons from the heavy oil zone that are mobilized under the influence of gravity by the heated fluid, such as SAGD.

SUMMARY OF THE INVENTION

The present invention teaches that by the appropriate and non-obvious application of existing elements of in situ recovery techniques, the gas in the overlying gas zone may be recovered while also recovering bitumen from the oil sand, together with a net enhancement of performance relative to that achievable with each of the in situ recovery elements applied separately.

The present invention is directed to a thermal recovery process for application in reservoirs with a gas-over-bitumen fluid configuration. The present invention is intended for application in an oil sand which is overlain by a gas zone in which said gas zone, or portions thereof, is contiguous with and hydraulically in communication with said oil sand, or portions thereof. The gas zone may be undepleted, or it may have undergone a substantial degree of depletion prior to the implementation of the subject invention. Such configurations of oil sand and overlying gas zone, with varying degrees of depletion of the latter, are common occurrences in Alberta's oil sands deposits.

In some embodiments, the present invention is directed to recovering bitumen in a combination of cyclic steam stimulation in the oil sand and in situ combustion in the gas zone, over the oil sand, with the relative contributions of each process depending on the reservoir characteristics and operating conditions.

The combination of these two existing recovery techniques, that is gas displacement of the overlying gas by means of in situ combustion and a steam-based recovery process, such as cyclic steam stimulation, in a horizontal well located in the underlying oil sand, represent two aspects of the present invention.

In the present invention, the combination of these two techniques provides for certain advantages when operated in specific manners. This operation and associated mechanisms, are summarized below using cyclic steam stimulation as the thermal recovery process within the underlying bitumen zone.

In a first aspect, the present invention provides a method for producing bitumen or heavy oil from a subsurface oil sands reservoir, the subsurface oil sands reservoir and an overlying gas zone in fluid communication, the method including providing an in situ combustion process in the overlying gas zone to create or expand a combustion front within the overlying gas zone, producing gas from the overlying gas zone, providing a thermal recovery process in the oil sands reservoir to create or expand a rising hot zone within the oil sands reservoir, producing bitumen or heavy oil from the oil sands reservoir, and providing heat from the in situ combustion process to the oil sands reservoir to provide an additional source of energy to the oil sands reservoir, wherein the rising hot zone does not intersect the overlying gas zone until the combustion front has moved beyond that portion of the overlying gas zone at the intersection. That is, the rising hot zone intersects the overlying gas zone only when or after the combustion front has moved past that portion of the overlying gas zone at the intersection.

In embodiments of the invention, the thermal recovery process is cyclic steam stimulation. In embodiments of the invention the thermal recovery process is a gravity controlled recovery process. In embodiments of the invention the gravity controlled recovery process is steam assisted gravity drainage.

In embodiments of the invention, the in situ combustion process is maintained by the injection of air.

In embodiments of the invention, the hot zone is operated at a hot zone pressure and the overlying gas zone is operated at a gas zone pressure. In embodiments of the invention, the hot zone pressure and the gas zone pressure are substantially equal. In embodiments of the invention, the gas zone pressure is greater than the hot zone pressure. In embodiments of the invention, the gas zone pressure and the hot zone pressure are selectively adjusted such that the gas zone pressure is governed by the hot zone pressure. In embodiments of the invention, the gas zone pressure is increased when the hot zone pressure is increased, for example during the injection phase of CSS. In embodiments of the invention, the gas zone pressure is decreased when the hot zone pressure is decreased, for example during the production phase of CSS. In embodiments of the invention, the method includes predicting a time of intersection of the rising hot zone with the overlying gas zone at which the combustion front has moved beyond that portion of the overlying gas zone at the intersection. In embodiments of the invention, the time of intersection is predicted based on modeling. In embodiments of the invention, the time of intersection is predicted based on field observation. In embodiments of the invention, the time of intersection is predicted based on a combination of modeling and field observation. In embodiments of the invention, providing the thermal recovery process is delayed relative to providing the in situ combustion process to prevent the rising hot zone from intersecting the overlying gas zone before the combustion front has moved beyond that portion of the overlying gas zone at the intersection.

In a further aspect, the present invention provides a method for reducing a steam-oil-ratio of a thermal recovery process for producing bitumen or heavy oil from a subsurface oil sands reservoir, the subsurface oil sands reservoir and an overlying gas zone in fluid communication, the method including providing an in situ combustion process in the overlying gas zone to create or expand a combustion front within the overlying gas zone, producing gas from the overlying gas zone, providing the thermal recovery process in the oil sands reservoir to create or expand a rising hot zone within the oil sands reservoir, producing bitumen or heavy oil from the oil sands reservoir, and providing heat from the in situ combustion process to the oil sands reservoir to provide an additional source of energy to the oil sands reservoir, wherein the rising hot zone does not intersect the overlying gas zone until the combustion front has moved beyond that portion of the overlying gas zone at the intersection. That is, the rising hot zone intersects the overlying gas zone only when or after the combustion front has moved past that portion of the overlying gas zone at the intersection.

In embodiments of the invention, the method includes predicting a time of intersection of the rising hot zone with the overlying gas zone at which the combustion front has moved beyond that portion of the overlying gas zone at the intersection. In embodiments of the invention, the time of intersection is predicted based on modeling. In embodiments of the invention, the time of intersection is predicted based on field observation. In embodiments of the invention, the time of intersection is predicted based on a combination of modeling and field observation. In embodiments of the invention, providing the thermal recovery process is delayed relative to providing the in situ combustion process to prevent the rising hot zone from intersecting the overlying gas zone before the combustion front has moved beyond that portion of the overlying gas zone at the intersection. In embodiments of the invention, an amount of injected steam is limited to prevent the rising hot zone from intersecting the overlying gas zone before the combustion front has moved beyond that portion of the overlying gas zone at the intersection. In embodiments of the invention, a pressure of injected steam is limited to prevent the rising hot zone from intersecting the overlying gas zone before the combustion front has moved beyond that portion of the overlying gas zone at the intersection. In embodiments of the invention, an amount and a pressure of injected steam are both limited to prevent the rising hot zone from intersecting the overlying gas zone before the combustion front has moved beyond that portion of the overlying gas zone at the intersection.

In a further aspect, the present invention provides a method for producing bitumen or heavy oil from a subsurface oil sands reservoir, the subsurface oil sands reservoir and an overlying gas zone in fluid communication, the method including providing an in situ combustion process in the overlying gas zone to create or expand a combustion front within the overlying gas zone, producing gas from the overlying gas zone, providing a thermal recovery process in the oil sands reservoir to create or expand a rising hot zone within the oil sands reservoir, producing bitumen or heavy oil from the oil sands reservoir, and providing heat from the in situ combustion process to the oil sands reservoir to provide an additional source of energy to the oil sands reservoir, wherein the rising hot zone intersects the overlying gas zone when the combustion front has moved beyond that portion of the overlying gas zone at the intersection. That is, the rising hot zone intersects the overlying gas zone only when the combustion front has moved past that portion of the overlying gas zone at the intersection.

In a further aspect, the present invention provides a method for producing bitumen or heavy oil from a subsurface oil sands reservoir, the subsurface oil sands reservoir and an overlying gas zone in fluid communication, the method including providing an in situ combustion process in the overlying gas zone to create or expand a combustion front within the overlying gas zone, producing gas from the overlying gas zone, providing a thermal recovery process in the oil sands reservoir to create or expand a rising hot zone within the oil sands reservoir, producing bitumen or heavy oil from the oil sands reservoir, confirming, based on field monitoring of operations, that the combustion front has moved beyond a portion of the overlying gas zone, and providing heat from the in situ combustion process to the oil sands reservoir to provide an additional source of energy to the oil sands reservoir, wherein the rising hot zone intersects the overlying gas zone at the portion of the overlying gas zone.

In a further aspect, the present invention provides a method for reducing a steam-oil-ratio of a thermal recovery process for producing bitumen or heavy oil from a subsurface oil sands reservoir, the subsurface oil sands reservoir and an overlying gas zone in fluid communication, the method including providing an in situ combustion process in the overlying gas zone to create or expand a combustion front within the overlying gas zone, producing gas from the overlying gas zone, providing the thermal recovery process in the oil sands reservoir to create or expand a rising hot zone within the oil sands reservoir, producing bitumen or heavy oil from the oil sands reservoir, predicting a time of intersection of the rising hot zone with the overlying gas zone at which the combustion front has moved beyond that portion of the overlying gas zone at the intersection, and providing heat from the in situ combustion process to the oil sands reservoir to provide an additional source of energy to the oil sands reservoir, wherein the rising hot zone does not intersect the overlying gas zone until the combustion front has moved beyond that portion of the overlying gas zone at the intersection. That is, the rising hot zone intersects the overlying gas zone only when or after the combustion front has moved past that portion of the overlying gas zone at the intersection.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
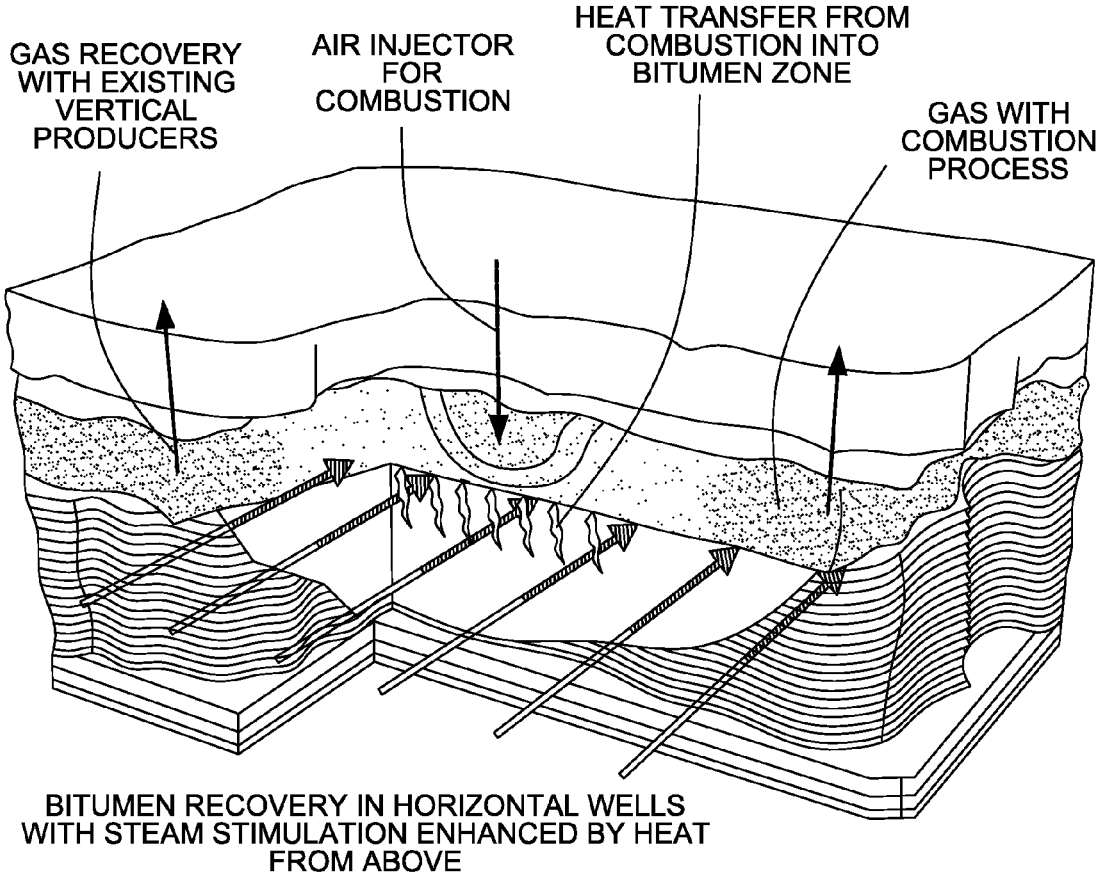
FIG. 1 is a perspective section view of an embodiment of the present invention, utilizing air injection, gas drive in an in situ combustion process and cyclic steam stimulation (CSS) in the thermal recovery process as applied to a gas-over-bitumen oil sands reservoir.
Figure 2:
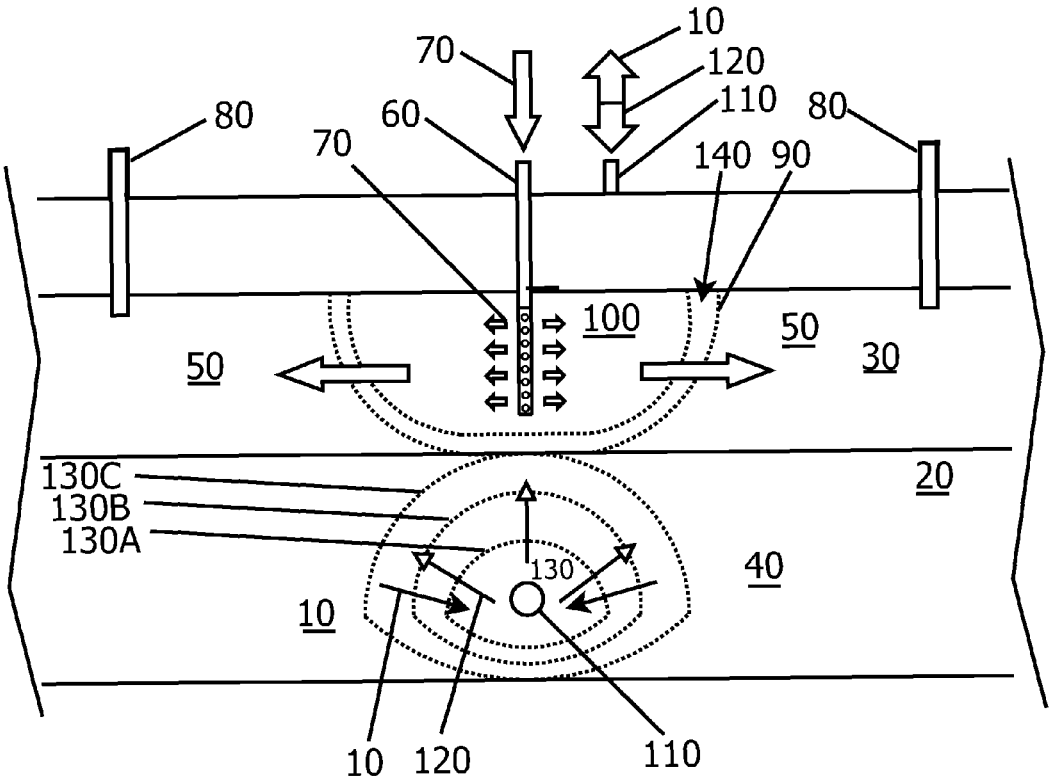
FIG. 2 is a simplified cross-section schematic of an embodiment of the present invention.

Referring to FIGS. 1 and 2, the present invention provides a process for recovering bitumen or heavy oil 10 from a subsurface oil sands reservoir 20, the subsurface oil sands reservoir 20 and an overlying gas zone 30 in fluid communication, commonly referred to as gas-over-bitumen.

Gas Over Bitumen

The overlying gas zone 30 is in fluid communication with a bitumen zone 40 in the oil sands reservoir 20.

Gas Zone

Within the overlying gas zone 30, wells are drilled and completed so as to be capable of displacing and recovering gas 50. An air injection well 60 is provided to allow the injection of air 70 into the gas zone 30, and gas recovery wells 80 are provided to produce gas 50 from the gas zone 30.

An in situ combustion process is initiated or sustained in the overlying gas zone 30, for example by the injection of air 70 or another combustion sustaining fluid into the overlying gas zone 30 via the air injection well 60. Combustion is initiated by ignition or other known techniques, and as additional air 70 is injected over time, a combustion front 90 moves outward from the air injection well 60, within the overlying gas zone 30, leaving in its wake a depleted gas zone 100. As the combustion front 90 moves outward from the air injection well 60, gas 50 such as natural gas and other gaseous hydrocarbons within the gas zone 30 are driven or swept to the gas recovery wells 80 and produced.

Oil Sand Reservoir

In the bitumen zone 40, a thermal recovery process is initiated or sustained, for example by cyclic steam stimulation (CSS) or another thermal recovery process, for example SAGD.

Within the bitumen zone 40 of the oil sand reservoir 20 a horizontal well is completed in the lower part of the oil sands reservoir 20. In the case of a CSS recovery process, the horizontal well is used for injection and production, which we will refer to as a CSS well 110. In the case of a SAGD recovery process, the horizontal well is used for production, and a separate well above the horizontal well is used for injection.

In a CSS thermal recovery process generally, a heated fluid, such as steam 120 is injected into the CSS well 110 in an injection phase, the heat allowed to soak into the bitumen zone 40 for a period of time, and then bitumen or heavy oil 10 is conveyed from the CSS well 110, by pumping or otherwise, in a production phase and recovered. The injection phase and the production phase are repeated in a cycle.

As steam 120 is repeatedly injected and bitumen or heavy oil 10 produced over time, a hot zone 130 is formed within the bitumen zone 40 and progressively expands outward and upward from the CSS well 110, to 130A, 1308, 130C etc.

Operation

In various embodiments, the in situ combustion process in the overlying gas zone 30 and the thermal recovery process in the oil sands reservoir 20 are operated in a coordinated manner.

If these two processes, the in situ combustion process in the overlying gas zone 30 and the thermal recovery process in the bitumen zone 40, are implemented and operated without special techniques that coordinate their respective mechanisms, the net result may be that overall performance is poorer than the performance experienced if each of the processes were operated separately.

To gain a net advantage over separate operation, certain phenomena must be understood and corresponding steps taken.

Timing

The first phenomenon relates to relative timing. Numerical modeling of the in situ combustion process and the thermal recovery process operating concurrently demonstrates that, with time, the hot zone 130 (region heated by the steam based process, cyclic steam stimulation in these model studies) will ascend and eventually intersect the overlying gas zone 30. The hot zone 130 invades the gas zone 30 and thereby interrupts or otherwise disrupts the in situ combustion gas displacement process, for example by invading the gas zone 30 in front of the combustion front 90 or invading the gas zone 30 near the combustion region 140, impacting the recovery of the gas 50 from the gas recovery wells 80.

Further numerical modeling studies have confirmed that to avoid this interference, the two processes, one operating from the gas zone 30 and the other from the bitumen zone 40, must be coordinated in a very specific manner. In particular, the in situ combustion process in the overlying gas zone 30 must have progressed sufficiently so that the combustion region 140 has passed beyond the hot zone 130 of rising heat from the underlying horizontal well of the thermal recovery process, such as CSS or SAGD. Thus, when rising hot fluids, such as steam 120, from the bitumen zone 40 reach or enter the gas zone 30, the combustion front 90 within the gas zone 90 should have already passed.

If the thermal recovery process occurs early and the rising heated fluid, such as steam 120, enters the gas zone 30 before the combustion front 90 has passed, that is, in front of the combustion front 90, the in situ combustion process within the gas zone 30 will be compromised or at least negatively impacted.

In various embodiments of the present invention, the timing of that interaction is delayed such that when the hot zone 130 reaches the overlying gas zone 30, the combustion front has passed through that region, i.e. the thermal recovery process only impacts upon the depleted gas zone 100 behind the combustion front 90 or behind the combustion region 140, and does not affect the combustion front 90 or the gas 50 itself within the overlying gas zone 30. This reduces the negative effects the rising hot zone 130, or steam 120 breakthrough, would have on the in situ combustion process. One method to achieve this result is to wait a sufficient period of time before operating the thermal recovery process. Another method is to operate the thermal recovery process at a selected (reduced) level or intensity, for example by limiting the amount or pressure or both of steam 120 injected. The interaction between the hot zone 130 and the gas zone 30 may be predicted, for example by modeling, experience, field monitoring of operations or a combination thereof.

Pressure

A further operating consideration is pressure. Excessive pressure, or pressure drawdown, associated with either the in situ combustion process or the thermal recovery process or both may compromise the overall effectiveness of the recovery.

Thus, excessive air injection pressure or amount or injection rate at the air injection well 60, or a corresponding, excessive pressure drawdown or amount or rate at the horizontal CSS well 110 during its production phase, or both, could result in entry of air 70 into the CSS well 110 and a resulting compromise of its integrity. Conversely, excessive pressure or amount or injection rate at the CSS well 110 during the injection phase could result in an acceleration and volumetric increase in the upward migration of heated fluids, such as steam 120, to or into the gas zone 30, thereby interfering with the displacement process in the overlying gas zone 30.

The pressure of the oil sands reservoir 20 and the pressure of the overlying gas zone 30 may be selectively controlled to provide improved operation. Accordingly, the combustion process and the thermal process benefit from operation at pressures which are relatively consistent with each other or substantially equal.

If a combined recovery process is operated in accordance with the above guidelines, at least two results may be provided, the sum of which is an improvement over the results with each individual process operating separately.

In the overlying gas zone 30, displacement of the gas 50 by in situ combustion will proceed largely unchanged in terms of performance metrics. However, the influence of this in situ combustion process within the gas zone 30 on the underlying bitumen zone 40 in the oil sand reservoir 20 may be very significant. In particular, the in situ combustion process provides an additional source of energy and thereby results in a significant reduction in steam-oil ratio (SOR) compared with the SOR that would be achieved with the thermal recovery process operating alone. Due to the relatively high temperatures of the in situ combustion process, the quality of the heat added is relatively high (e.g. relatively high temperature) providing a high heat transfer rate and heat flux added to the underlying bitumen zone 40.

In addition, gains in SOR performance (i.e., SOR reduction) are realized because at least a portion of the fluids, such as air, water, or $CO_2$, from the in situ combustion process generates benefits within the oil sand reservoir 20. This raises the consideration of whether performance improvement in the oil sand reservoir 20 is offset by performance reduction of the gas displacement process that is occurring in the overlying gas zone 30. Modeling results confirm that the improvement in the recovery of bitumen or heavy oil 10 that occurs as a consequence of contact with overlying air 70 (oxygen) is very significant, and any corresponding reduction that might occur to the overlying gas displacement process because some of the air-related energy is diverted to improvement of the thermal recovery process is very small or negligible.

Thus, the present invention provides improvement in a key performance metric associated with steam-based bitumen recovery processes (SOR), utilizes a novel combination of elements to do this, identifies non-obvious phenomena and discloses operating techniques that must be recognized and implemented if the process is to be maximized.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method for producing bitumen or heavy oil from a subsurface oil sands reservoir, the subsurface oil sands reservoir and an overlying gas zone in fluid communication, the method comprising:

providing an in situ combustion process in the overlying gas zone to create or expand a combustion front within the overlying gas zone; and producing gas from the overlying gas zone;

providing a thermal recovery process in the oil sands reservoir to create or expand a rising hot zone within the oil sands reservoir;

producing bitumen or heavy oil from the oil sands reservoir; and providing heat from the in situ combustion process to the oil sands reservoir to provide an additional source of energy to the oil sands reservoir, wherein the rising hot zone does not intersect the overlying gas zone until the combustion front has moved beyond that portion of the overlying gas zone at the intersection.

2. The method of claim 1, wherein the thermal recovery process comprises cyclic steam stimulation.

3. The method of claim 1, wherein the thermal recovery process comprises a gravity controlled recovery process.

4. The method of claim 3, wherein the gravity controlled recovery process comprises steam assisted gravity drainage.

5. The method of claim 1, wherein the in situ combustion process is maintained by the injection of air into the overlying gas zone.

6. The method of claim 1, wherein the hot zone is operated at a hot zone pressure and the overlying gas zone is operated at a gas zone pressure.

7. The method of claim 6, wherein the hot zone pressure and the gas zone pressure are substantially equal.

8. The method of claim 6, wherein the gas zone pressure is greater than the hot zone pressure.

9. The method of claim 6, wherein the gas zone pressure and the hot zone pressure are adjusted such that the gas zone pressure is governed by the hot zone pressure.

10. The method of claim 9, wherein the gas zone pressure is increased when the hot zone pressure is increased.

11. The method of claim 10, wherein the thermal recovery process comprises cyclic steam stimulation and the hot zone pressure is increased during an injection phase of cyclic steam stimulation.

12. The method of claim 9, wherein the gas zone pressure and the hot zone pressure are decreased. gas zone pressure is decreased when the hot zone pressure is decreased.

13. The method of claim 12, wherein the thermal recovery process comprises cyclic steam stimulation and the hot zone pressure is decreased during a production phase of cyclic steam stimulation.

14. The method of claim 1, further comprising predicting a time of intersection of the rising hot zone and the overlying gas zone at which the combustion front has moved beyond that portion of the overlying gas zone at the intersection.

15. The method of claim 14 wherein the time of intersection is predicted based on modeling.

16. The method of claim 14 wherein the time of intersection is predicted based on field observation.

17. The method of claim 14 wherein the time of intersection is predicted based on a combination of modeling and field observation.

18. The method of claim 14 wherein providing the thermal recovery process is delayed relative to providing the in situ combustion process to prevent the rising hot zone from intersecting the overlying gas zone before the combustion front has moved beyond that portion of the overlying gas zone at the intersection.

19. A method for reducing a steam-oil-ratio of a thermal recovery process for producing bitumen or heavy oil from a subsurface oil sands reservoir, the subsurface oil sands reservoir and an overlying gas zone in fluid communication, the method comprising:

providing an in situ combustion process in the overlying gas zone to create or expand a combustion front within the overlying gas zone;

producing gas from the overlying gas zone;

providing the thermal recovery process in the oil sands reservoir to create or expand a rising hot zone within the oil sands reservoir;

producing bitumen or heavy oil from the oil sands reservoir; and providing heat from the in situ combustion process to the oil sands reservoir to provide an additional source of energy to the oil sands reservoir, wherein the rising hot zone does not intersect the overlying gas zone until the combustion front has moved beyond that portion of the overlying gas zone at the intersection.

20. The method of claim 19, further comprising predicting a time of intersection of the rising hot zone with the overlying gas zone at which the combustion front has moved beyond that portion of the overlying gas zone at the intersection.

21. The method of claim 19 wherein the time of intersection is predicted based on modeling.

22. The method of claim 19 wherein the time of intersection is predicted based on field observation.

23. The method of claim 19 wherein the time of intersection is predicted based on a combination of modeling and field observation.

24. The method of claim 19 wherein providing the thermal recovery process is delayed relative to providing the in situ combustion process to prevent the rising hot zone from intersecting the overlying gas zone before the combustion front has moved beyond that portion of the overlying gas zone at the intersection.

25. The method of claim 19 wherein the thermal recovery process includes injecting an amount of steam, and the amount of steam is limited to prevent the rising hot zone from intersecting the overlying gas zone before the combustion front has moved beyond that portion of the overlying gas zone at the intersection.

26. The method of claim 19 wherein the thermal recovery process includes injecting steam at a pressure, and the pressure is limited to prevent the rising hot zone from intersecting the overlying gas zone before the combustion front has moved beyond that portion of the overlying gas zone at the intersection.

27. The method of claim 19 wherein the thermal recovery process includes injecting an amount of steam at a pressure, and the amount of steam and the pressure are both limited to prevent the rising hot zone from intersecting the overlying gas zone before the combustion front has moved beyond that portion of the overlying gas zone at the intersection.

28. A method for producing bitumen or heavy oil from a subsurface oil sands reservoir, the subsurface oil sands reservoir and an overlying gas zone in fluid communication, the method comprising:

providing an in situ combustion process in the overlying gas zone to create or expand a combustion front within the overlying gas zone;

producing gas from the overlying gas zone;

providing a thermal recovery process in the oil sands reservoir to create or expand a rising hot zone within the oil sands reservoir;

producing bitumen or heavy oil from the oil sands reservoir; and providing heat from the in situ combustion process to the oil sands reservoir to provide an additional source of energy to the oil sands reservoir, wherein the rising hot zone intersects the overlying gas zone when the combustion front has moved beyond that portion of the overlying gas zone at the intersection.

29. A method for producing bitumen or heavy oil from a subsurface oil sands reservoir, the subsurface oil sands reservoir and an overlying gas zone in fluid communication, the method comprising:

providing an in situ combustion process in the overlying gas zone to create or expand a combustion front within the overlying gas zone;

producing gas from the overlying gas zone;

providing a thermal recovery process in the oil sands reservoir to create or expand a rising hot zone within the oil sands reservoir;

producing bitumen or heavy oil from the oil sands reservoir;

confirming, based on field monitoring of operations, that the combustion front has moved beyond a portion of the overlying gas zone; and providing heat from the in situ combustion process to the oil sands reservoir to provide an additional source of energy to the oil sands reservoir, wherein the rising hot zone intersects the overlying gas zone at the portion of the overlying gas zone.

30. A method for reducing a steam-oil-ratio of a thermal recovery process for producing bitumen or heavy oil from a subsurface oil sands reservoir, the subsurface oil sands reservoir and an overlying gas zone in fluid communication, the method comprising:

providing an in situ combustion process in the overlying gas zone to create or expand a combustion front within the overlying gas zone;

producing gas from the overlying gas zone;

providing the thermal recovery process in the oil sands reservoir, to create or expand a rising hot zone within the oil sands reservoir;

producing bitumen or heavy oil from the oil sands reservoir;

predicting a time of intersection of the rising hot zone with the overlying gas zone at which the combustion front has moved beyond that portion of the overlying gas zone at the intersection;

providing heat from the in situ combustion process to the oil sands reservoir to provide an additional source of energy to the oil sands reservoir; and wherein the rising hot zone does not intersect the overlying gas zone until the combustion front has moved beyond that portion of the overlying gas zone at the intersection.

* * * * *